US007089844B2

(12) United States Patent
Becker

(10) Patent No.: US 7,089,844 B2
(45) Date of Patent: Aug. 15, 2006

(54) DEVICE FOR ELECTRICALLY CONTROLLING AN AUTOMATIC WEAPON

(75) Inventor: Wolfgang Becker, Vellmar (DE)

(73) Assignee: Krauss-Maffei Wegmann GmbH & Co. KG, (DE)

( * ) Notice: Subject to any disclaimer, the term of this patent is extended or adjusted under 35 U.S.C. 154(b) by 0 days.

(21) Appl. No.: 10/526,441

(22) PCT Filed: Aug. 12, 2003

(86) PCT No.: PCT/DE03/02708

§ 371 (c)(1),
(2), (4) Date: Apr. 25, 2005

(87) PCT Pub. No.: WO2004/023057

PCT Pub. Date: Mar. 18, 2004

(65) Prior Publication Data

US 2005/0262992 A1 Dec. 1, 2005

(30) Foreign Application Priority Data

Sep. 3, 2002 (DE) ..... 102 40 507

(51) Int. Cl.
*F41A 1/00* (2006.01)

(52) U.S. Cl. ..... 89/9; 89/11; 89/136; 89/135

(58) Field of Classification Search ..... 89/9, 89/11, 136, 135

See application file for complete search history.

(56) References Cited

U.S. PATENT DOCUMENTS 2,413,416 A 12/1946 Ostlund et al.
3,181,423 A * 5/1965 Rocha ..... 89/161
3,352,206 A 11/1967 Draper
3,967,530 A * 7/1976 Vorgrimler et al. ..... 89/135
4,062,267 A * 12/1977 Vinches et al. ..... 89/41.19
4,508,006 A * 4/1985 Post et al. ..... 89/24
4,787,291 A * 11/1988 Frohock, Jr. ..... 89/41.22
4,796,512 A * 1/1989 Koine ..... 89/11

FOREIGN PATENT DOCUMENTS

FR 914885 10/1946

* cited by examiner

*Primary Examiner*—M. Clement
(74) *Attorney, Agent, or Firm*—Robert W Becker & Associates; Robert W Becker

(57) ABSTRACT

A device for controlling an automatic weapon is provided. Disposed on or in a housing detachably mounted on the weapon is an electric drive motor, controlled by an electric control device, that drives a threaded spindle having a spindle nut on which is disposed a driver. A cocking bolt is guided on the housing and is coupled with a safety catch of the weapon, and is disposed in the path of movement of the driver and is movable out of a starting position, counter to the spring force acting on a safety catch, back to a cocking position in an end position of the spindle nut. In the cocking position, the cocking bolt is arrested by an arresting lever in the end position of the spindle nut, corresponding to the safety condition of the weapon. The cocking bolt is released by the spindle nut during its advancement in the starting position thereof, which corresponds to the released safety catch position of the weapon and leads to advancement of the cocking bolt and safety catch.

7 Claims, 2 Drawing Sheets

(TOP VIEW)

(SIDE VIEW)

(REAR VIEW)

DEVICE FOR ELECTRICALLY CONTROLLING AN AUTOMATIC WEAPON

BACKGROUND OF THE INVENTION

The present invention relates to a device for electrically controlling an automatic weapon, whereby the term control initially refers to the cocking, locking of the safety catch, and unlocking of the safety catch of the weapon, and furthermore to the firing of the weapon and possibly to the sensing of certain conditions at the weapon.

The object of the invention is to provide a device for electrically controlling an automatic weapon that can be used with different types of weapons having various designs, and that permits an automatic weapon, which is customarily operated manually, to be operated with remote control, for example from the interior of a tank.

The realization of this object is inventively effected via a device for electrically controlling an automatic weapon that is characterized by a housing that is detachably mounted on the side of the weapon and on or in which is disposed an electric drive motor that can be controlled by an electric control device; the drive motor drives a threaded spindle that extends parallel to the longitudinal axis of the weapon and on which a spindle nut is movable out of a starting position, counter to the firing direction, back into an end position; a driver is disposed on the spindle nut in such a way that a cocking bolt that is guided on the housing and is coupled with the breechblock of the weapon is disposed in the path of movement of the driver and is movable out of a starting position, counter to the spring force acting on the breechblock of the weapon, back into a cocking position in the end position of the spindle nut, in which it is arrested by an arresting lever disposed on the housing in the end position of the spindle nut, corresponding to a "safety" condition of the weapon, and is released by the spindle nut during advancement of the spindle nut in its starting position, which corresponds to the "released safety catch" condition of the weapon and leads to an advancement of the cocking bolt and breechblock of the weapon.

SUMMARY OF THE INVENTION

The basic concept of the invention is to provide a device that is mounted on an automatic weapon, preferably by means of a quick-release, and that, controlled by an electrical control device that may be disposed at a remote location, automatically enables certain operations of the weapon control, such as the cocking, locking of the safety catch, unlocking of the safety catch, and firing of the weapon.

For this purpose, the device first of all has a threaded spindle that is driven by an electric motor and with the aid of which, as will be described in greater detail subsequently with the aid of an embodiment, the cocking of the breechblock can be carried out, whereby the configuration is such that after the cocking, the weapon initially is automatically in the safety condition, and an unlocking or release of the safety catch, and hence an advancement of the breechblock and the carrying out of certain functions, such as, for example, a supply of rounds or cartridges, can be carried out only after the automatic locking of the safety catch is released, i.e., as a consequence of a further signal the weapon is shifted into the unlocked safety catch condition.

A particular advantage of the inventive device is that the driver that is disposed on the spindle nut is not fixedly connected with the cocking bolt, and is preferably spring-mounted on the spindle nut in such a way that when the end position is reached, no overloading can occur. As a result of this uncoupling of cocking bolt and driver, it is also possible to manually operate the weapon at any time.

The device can advantageously be embodied in such a way that there is further provided in the device an electromagnet for the firing of the weapon, and a series of sensors can be provided that detect certain conditions of the device and of the weapon. For example, a sensor can be disposed in such a way that it determines if a weapon is even mounted on the device. This can be important, for example, in the stabilized operation on a tank. Furthermore, sensors can be provided that indicate the position of the breechblock of the weapon and/or carry out a round count.

BRIEF DESCRIPTION OF THE DRAWINGS

An embodiment for a device for electrically controlling an automatic weapon pursuant to the invention is explained in greater detail subsequently with the aid of the accompanying drawings.

The drawings show.

DESCRIPTION OF SPECIFIC EMBODIMENTS

Figure 3:
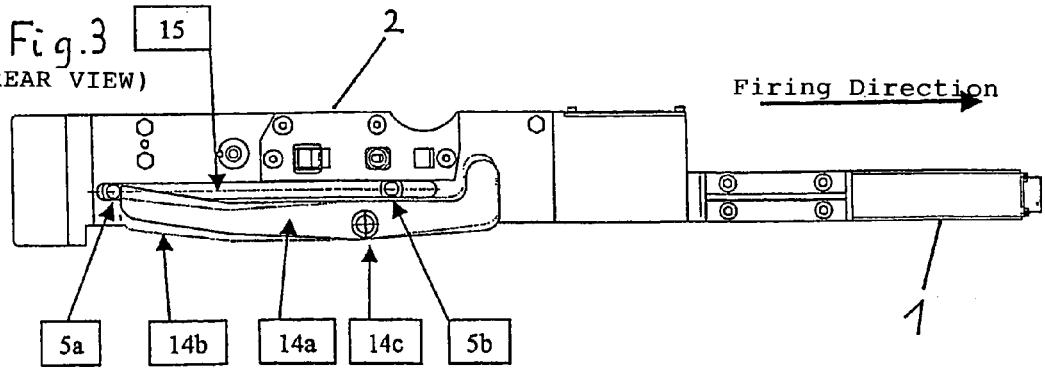
FIG. 3 in a side view from the rear, the device of FIG. 2.

The device illustrated in FIGS. 1 to 4 has a housing 2 that is mounted on an automatic weapon W via a non-illustrated quick-release coupling that depends on the type of weapon. The quick-release coupling can be released by means of a rotary knob 4. Disposed on the housing 2 is an electric drive motor 1 that can be controlled by an electric control device 16 illustrated in FIG. 4. The drive motor 1 drives a threaded spindle 6 that extends parallel to the longitudinal axis L of the weapon and on which a spindle nut 10 is movable out of a starting position at the end of the threaded spindle 6 on the motor side, counter to the firing direction, into an end position illustrated in FIG. 2. A driver 9 is spring-mounted and disposed on the spindle nut 10 in such a way that a cocking bolt 5, which is guided on the housing 2 and is coupled with the breechblock of the weapon, is disposed in the path of movement of the driver in such a way that the cocking bolt 5 can be moved out of a non-illustrated starting position, against the spring force that acts upon the breechblock of the weapon, back into a cocking position, illustrated in FIG. 2, in the end position of the spindle nut 10. This means that cocking bolt 5 and driver 9 are basically uncoupled, so that the cocking bolt 5, and hence the breechblock, can also be operated manually. In the end position of the spindle nut 10 illustrated in FIG. 2, in other words the cocking position of a securing bolt 5, the cocking bolt 5 is captured and retained by an arresting lever that is illustrated in FIG. 3. In FIG. 3, the arresting lever is illustrated in solid lines in a resting position and is designated in this position by 14*a*. The arresting lever 14*a* is pivotable about an axis 14*c*, against the force of a torsion spring, out of the arresting position into the release position designated by 14*b*. In the end position of the spindle nut 10 illustrated in FIG. 2, the arresting lever 14*a* is retained in the arresting position, so that the cocking bolt is locked or arrested in the position 5*a* illustrated in FIG. 3. This corresponds to the safety condition of the weapon in which the breechblock of the weapon is also retained and cannot advance.

If, upon an appropriate signal coming from the electric control device 16, the spindle nut 10 again advances into its starting position, it pivots the arresting lever into the release position indicated by 14*b*, and the cocking bolt 5*a*, together with the breechblock of the weapon, moves forward under spring force until the cocking bolt assumes the position designated by 5*b* in FIG. 3. This corresponds to the unlocked or released safety catch condition of the weapon. During the advancement, the breechblock of the weapon performs appropriate functions, such as, for example, the supply of rounds or cartridges.

Disposed in the housing 2 is an electromagnet 3 for the firing of the weapon as a consequence of a firing signal coming from the electric control device. Furthermore arranged in the housing 2 is a first sensor 7 that is connected with the electric control device and establishes whether the housing 2 is disposed on a weapon W. Further sensors 11 and 12 show the positions "breechblock forward" or "breechblock to the rear", and a sensor 8 senses, via the cocking bolt 5, the return of the safety catch and conveys pulses to the electric control device, with the aid of which a round count is carried out.

Figure 1:
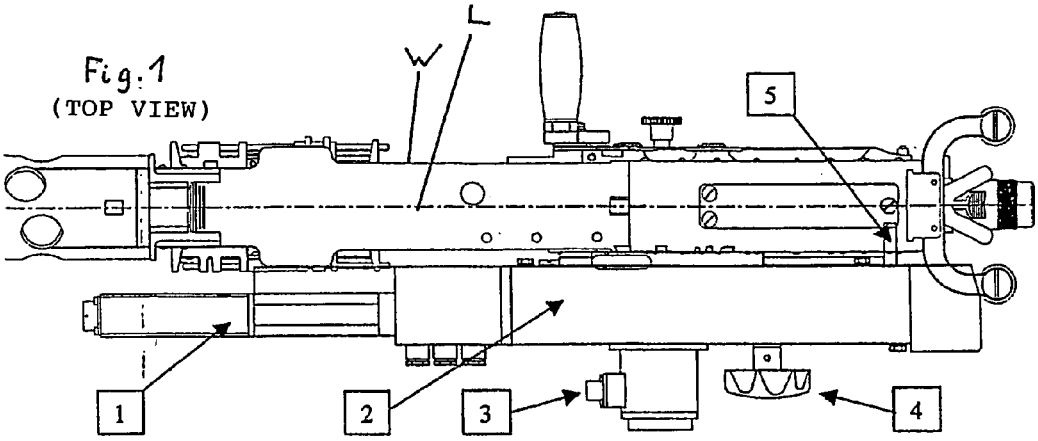
FIG. 1 in a top view, a portion of an automatic weapon having a device for the electrical control mounted thereon.
Figure 2:
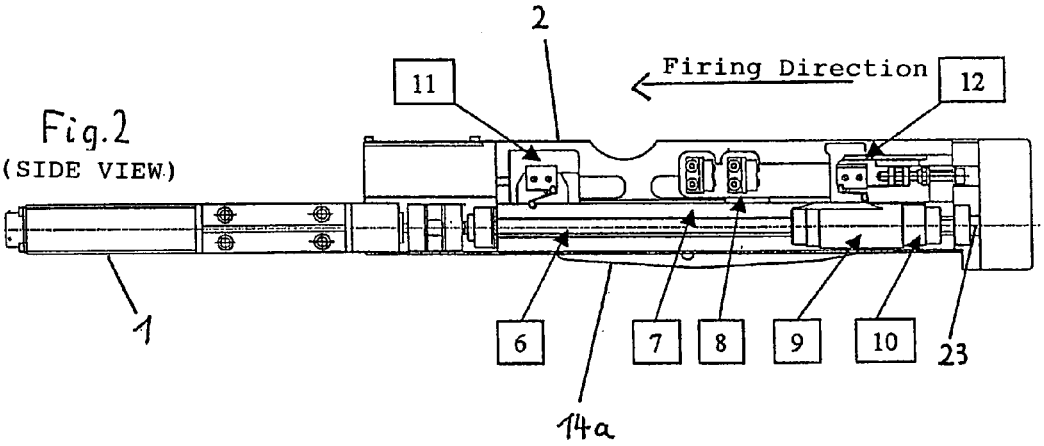
FIG. 2 in a side view, the device for the electrical control according to FIG. 1.
Figure 4:
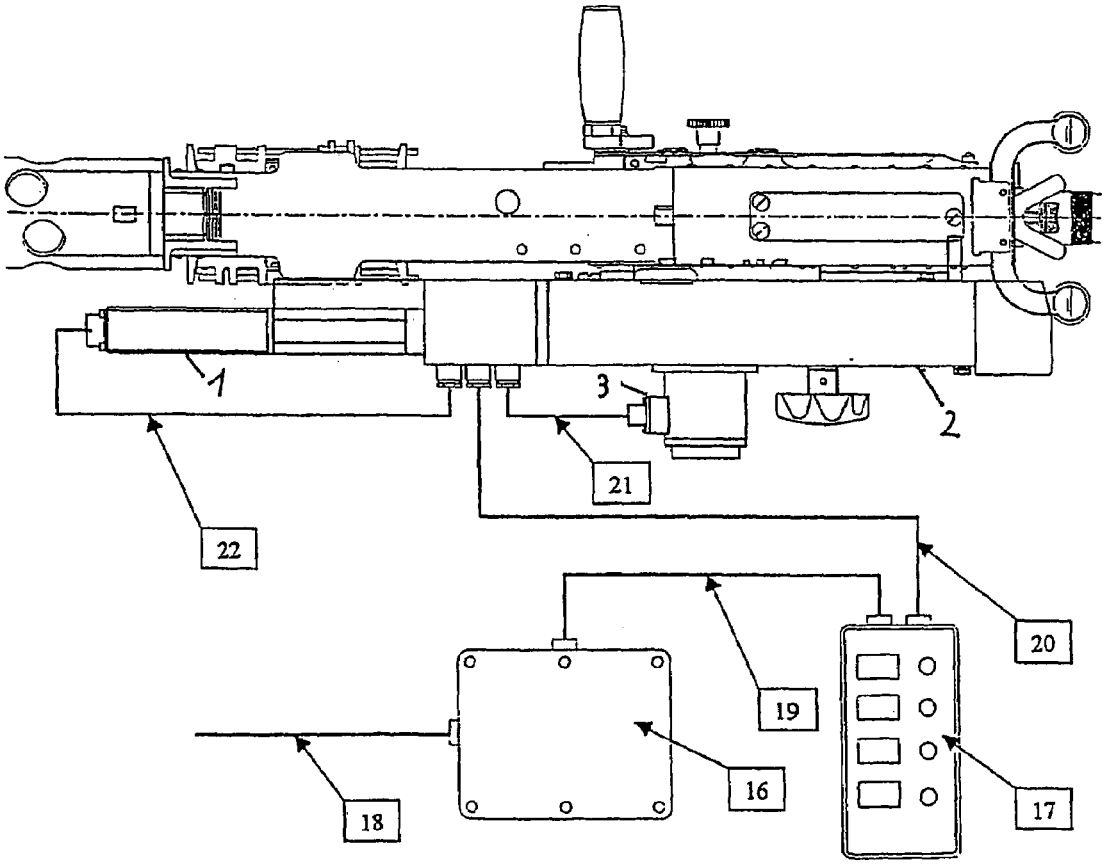
FIG. 4 in an illustration analogous to FIG. 1, the device mounted on the automatic weapon for the electrical control with the electrical control device.

FIG. 4 shows the same illustration as does FIG. 1, whereby the already described mechanical components of the device, namely the drive motor 1, the housing 2 and the electromagnet 3 for firing the weapon, are illustrated in the same manner as in FIG. 1. FIG. 4 furthermore shows an electric control device 16, which on the one hand is connected to a power supply 18 and on the other hand is connected via a line 19 to a control unit 17, from which control signals are conveyed via a line 20, and further on the one hand via a line 22 to the drive motor 1 and on the other hand via a line 21 to the electromagnet 3.

In case of emergency, a manual operation of the device is possible. As can be seen from FIG. 2, this can occur by placing a crank or a handwheel at the end 23 of the threaded spindle 6.

The specification incorporates by reference the disclosure of German priority document 102 40 507.7 filed Sep. 3, 2002 and PCT/DE2003/002708 filed Aug. 12, 2003.

The present invention is, of course, in no way restricted to the specific disclosure of the specification and drawings, but also encompasses any modifications within the scope of the appended claims.

The invention claimed is:

1. A device for electrically controlling an automatic weapon comprising:

a housing that is detachably mounted on a side of said weapon;

an electric drive motor disposed on or in said housing;

an electric control device for controlling said electric drive motor;

a threaded spindle that extends parallel to a longitudinal axis of said drive motor;

a spindle nut that is movable on said threaded spindle out of a starting position, counter to a firing direction, back into an end position;

a driver disposed on said spindle nut;

a cocking bolt that is guided on said housing and is coupled with a safety catch of said weapon, wherein said driver is disposed on said spindle nut in such a way that said cocking bolt is disposed in a path of movement of said driver and is movable out of a starting position, counter to spring force acting on said safety catch, back into a cocking position in said end position of said spindle nut; and an arresting lever disposed on said housing, wherein said cocking bolt, in said cocking position, is arrested by said arresting lever in said end position of said spindle nut, corresponding to a safety condition of said weapon, and wherein said cocking bolt is released by said spindle nut during advancement of said spindle nut in said starting position thereof, which corresponds to a released safety catch condition of said weapon and leads to an advancement of said cocking bolt and said safety catch of said weapon.

2. A device according to claim 1, wherein said driver is spring-mounted on said spindle nut.

3. A device according to claim 1, wherein said housing is mounted on said weapon via a rapid-release coupling, and wherein said cocking bolt is connected to said safety catch of said weapon via a releasable coupling mechanism.

4. A device according to claim 1, wherein an electromagnet is disposed in said housing for a firing of said weapon as a consequence of a firing signal coming from said electric control device.

5. A device according to claim 1, wherein a first sensor is disposed in or on said housing for determining whether said housing is disposed on a weapon, and wherein said first sensor is connected with said control device.

6. A device according to claim 5, wherein at least one second sensor is disposed in or on said housing for sensing a position of said safety catch of said weapon, and wherein said at least one second sensor is connected with said control device.

7. A device according to claim 6, wherein a third sensor is disposed in or on said housing for counting rounds, and wherein said third sensor is connected with said control device.

* * * * *